US006019641A

United States Patent [19]

Kan

[11] Patent Number: 6,019,641

[45] Date of Patent: Feb. 1, 2000

[54] ELECTRIC CONNECTOR

[76] Inventor: Bright Kan, No. 2-1, Chung Fu Rd., Sec. 2, Chung Li City, Taiwan

[21] Appl. No.: 09/185,590

[22] Filed: Nov. 4, 1998

[51] Int. Cl.[7] ..... H01R 23/02

[52] U.S. Cl. ..... 439/676; 439/941

[58] Field of Search ..... 439/676, 941, 439/344, 637, 502, 733.1, 709, 741; 379/442

[56] References Cited

U.S. PATENT DOCUMENTS

| | | | |
|---|---|---|---|
| 5,277,625 | 1/1994 | Iannella et al. | 439/620 |
| 5,419,720 | 5/1995 | Chen | 439/676 |
| 5,697,817 | 12/1997 | Bouchan et al. | 439/676 |

*Primary Examiner*—Steven L. Stephan
*Assistant Examiner*—Barry M. L. Standig
*Attorney, Agent, or Firm*—Dougherty & Troxell

[57] ABSTRACT

An electrical connector includes a hollow socket, an insert engageable with the socket and a plural number of terminals located in the terminal slots formed in the insert. The socket has two rows of pressing rib to press the terminals against a terminal stopper so that terminals may be held securely and precisely in a plural number of separating ridges. The insert has two levels of V-shaped terminal slots and wedge slots to hold terminals securely therein. Each terminal has pointed bulges on lateral edges to engage with the terminal slot. The socket has fully covered walls to prevent crosstalk interference.

1 Claim, 5 Drawing Sheets

ELECTRIC CONNECTOR

BACKGROUND OF THE INVENTION

1. Field of the Invention

This invention relates to an electric connector and particularly to an electric connector that has two levels of terminal slots for reducing crosstalk interference.

2. Description of the Prior Art

Electric connectors have been widely used in electrical devices. They have many different forms and structures to suit different requirements. However they mostly have some shortcomings such as terminals are difficult to hold in position steadily (i.e., easy to get loose), difficult to assemble, not perfect electric contact, poor insulation and resulting in crosstalk interference, etc. The crosstalk interference is particularly troublesome to communication devices. FIGS. 6 and 7 show two examples of conventional electric connector. In FIG. 7, the socket 18 has an upper slot 181 which will expose terminals 20, 21 to outside. Moreover the terminals go through the terminal slots 191 which are laid on a plane without cover. All this makes crosstalk interference a severe problem. FIG. 6 shows another conventional connector which has a cover over the terminals, but the terminals 16 and 17 have to be individually inserted into terminal passages 151. It is time-consuming. The terminals also cannot be securely fixed in the terminal passage 151 and may result in terminal slipping away from the terminal passage.

SUMMARY OF THE INVENTION

In view of aforesaid disadvantages, it is therefore an object of this invention to provide an electric connector that has two levels of terminal slots which have greater distance between them to prevent crosstalk interference so that telecommunication signals may be transmitted more reliably.

It is another object of this invention to provide an electric connector that has pressing ribs to position the terminals precisely and easily so that the reliability of electrical signal transmission may be further enhanced, and assembly of the connector is also simple and easy.

BRIEF DESCRIPTION OF THE DRAWINGS

The invention, as well as its many advantages, may be further understood by the following detailed description and drawings in which.

DETAILED DESCRIPTION OF THE PREFERRED EMBODIMENT

Figure 1:
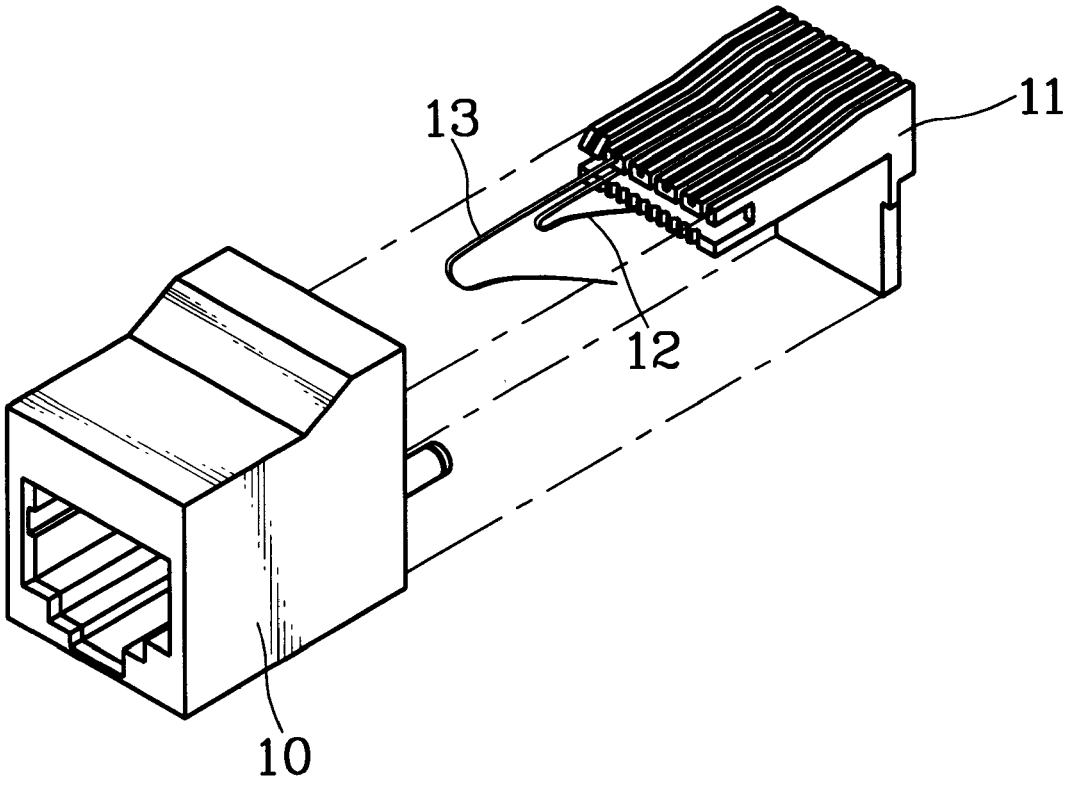
FIG. 1 is an exploded view of this invention.
Figure 2C:
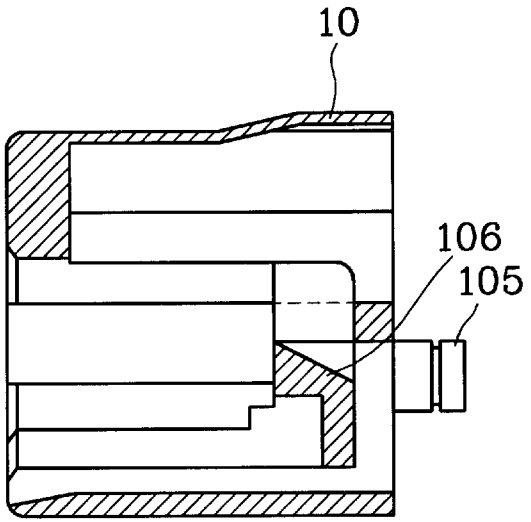
FIGS. 2A, 2B and 2C are respectively a front view, a rear view and a sectional view of a socket of this invention.
Figure 2B:
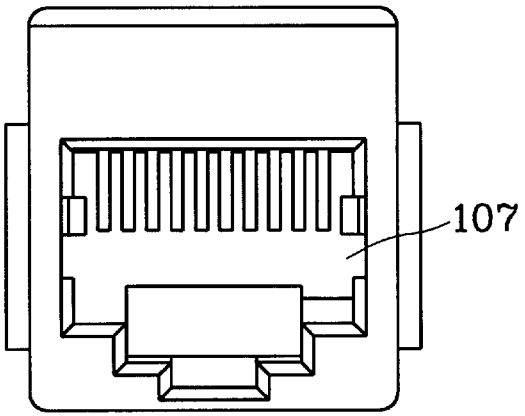
Figure 2A:
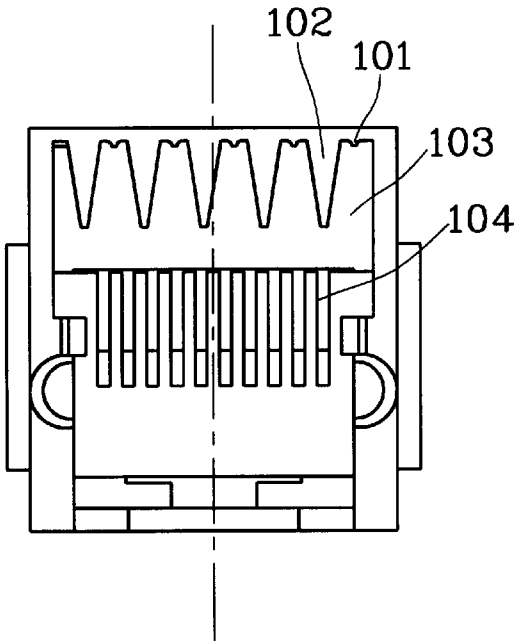

Referring to FIG. 1, an electric connector according to this invention includes a socket 10, an insert 11 and a plural number of lower terminals 12 and upper terminal 13. The terminals 12 and 13 are located in the insert 11 which is then be pressed into the socket 10 for connecting with a plug and wiring to power supply. The socket 10 (shown in FIGS. 2A, 2B and 2C) is made by plastics injection moulding. It has an inside cavity, an insert opening 103, separating ridges 104, a pair of latching hooks 105 and a plug opening 107. The separating ridges 105 are mounted on an inclined stopper 105. The top wall of the socket 10 is a solid wall for fully cover the terminals to be held in the socket. At the insert opening 103 and below the top wall, there are provided with upper pressing ribs 101 and lower pressing ribs 102, which make the terminals 12 bending at a desired angle. The distance between the upper pressing ribs 101 and lower pressing ribs 102 is larger than the distance between two adjacent separating ridges 104 for reducing crosstalk interference.

Figures 3A, 3B, 3C:
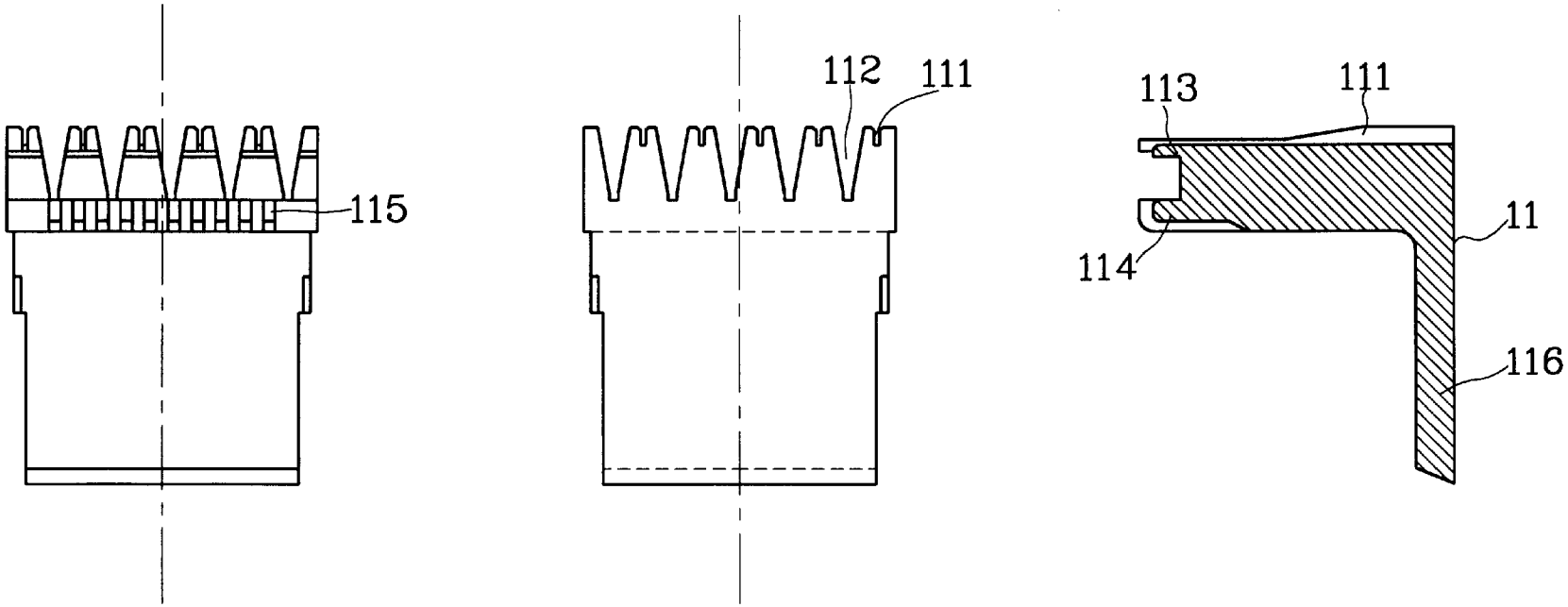
FIGS. 3A, 3B and 3C are respectively a front view, a rear view and a sectional view of an insert of this invention.

Referring to FIGS. 3A, 3B and 3C, the insert 11 is also made by plastics injection moulding and formed in a substantially L-shaped crosssection. It has a covering board 116 at one side. There is a terminal board normal to the covering board 116 that have V-shaped upper terminals slots 111 and lower terminal slots 112 formed therein. At one end opposite to the covering board, the terminal board has an upper bend 113 and a lower bend 114 that further have a plural number of wedge slots 115 for holding terminals therein. The distance between two terminal slots 111 and 112 is larger than that of the wedges slots 115 at lower bend 114 (shown in FIG. 3A) so that the terminal may be held therein with less crosstalk interference.

Figure 5B:
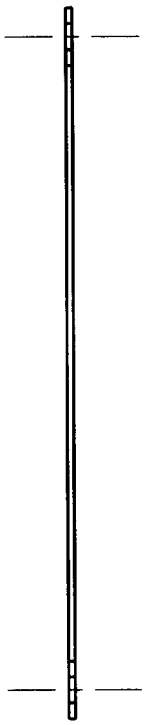
FIGS. 5A and 5B are respectively a front and a side view of terminal stamping plate of this invention.
Figure 5A:
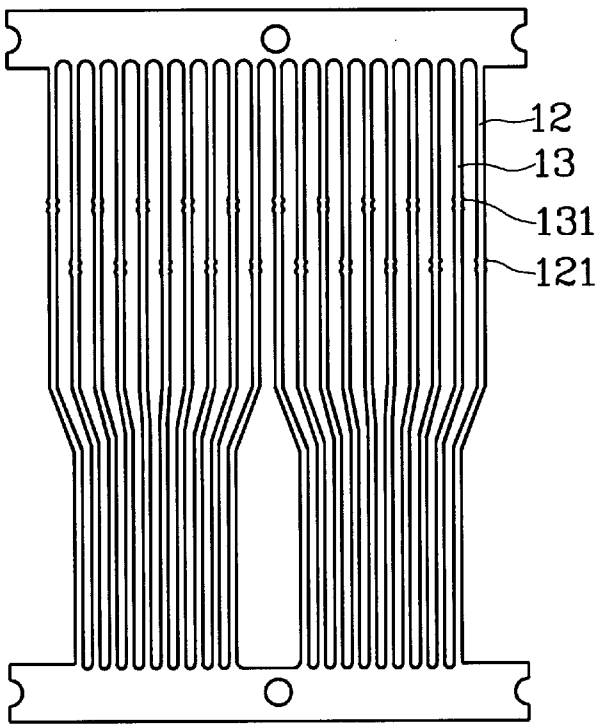

Referring to FIGS. 5A and 5B, the terminals 12 and 13 are made by stamping a thin brass plate into narrow strips to fit into the terminal slots 111, 112 and wedge slots 115. At two lateral sides of each terminal strip, pointed bulges 121 and 131 may be formed to enable the terminals 12 and 13 securely engage with the terminal slots 111 and 112. It also makes terminal positioning more precisely.

Figure 4:
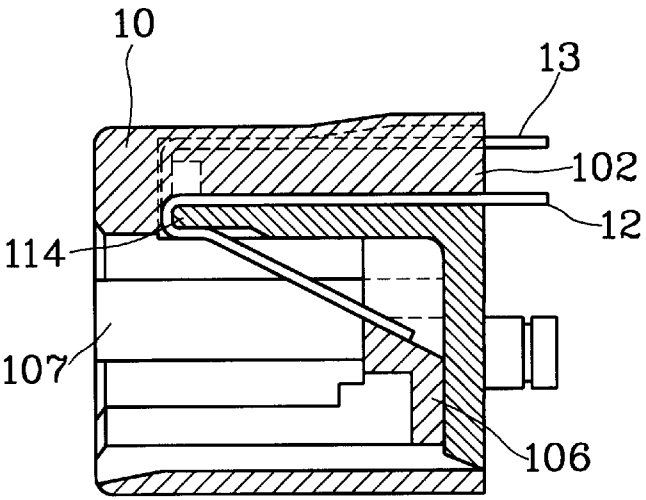
FIG. 4 is a sectional view of this invention, after assembled.
Figure 6:
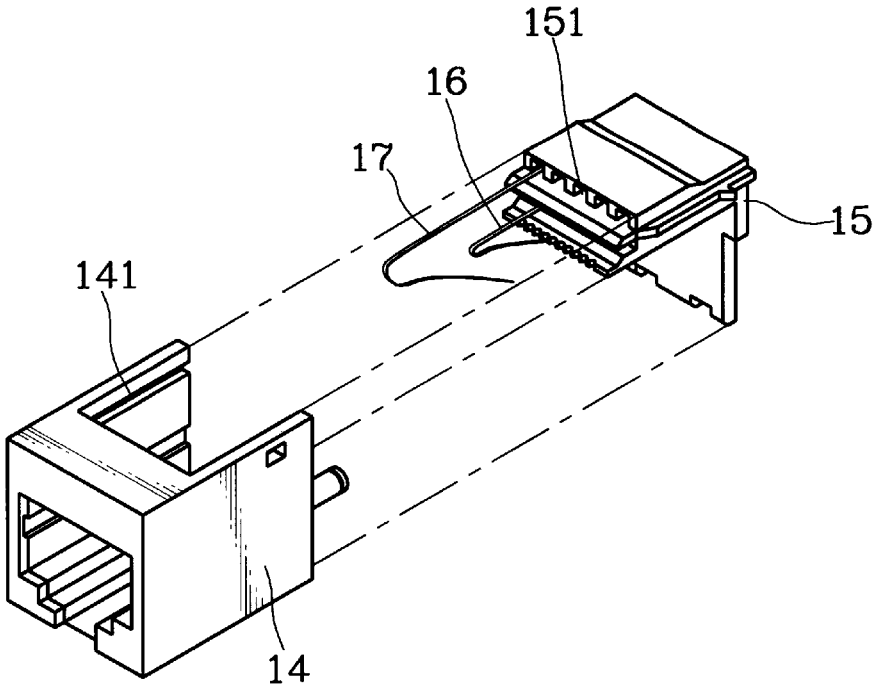
FIG. 6 (PRIOR ART)
FIG. 6 is an exploded view of a conventional connector.
Figure 7:
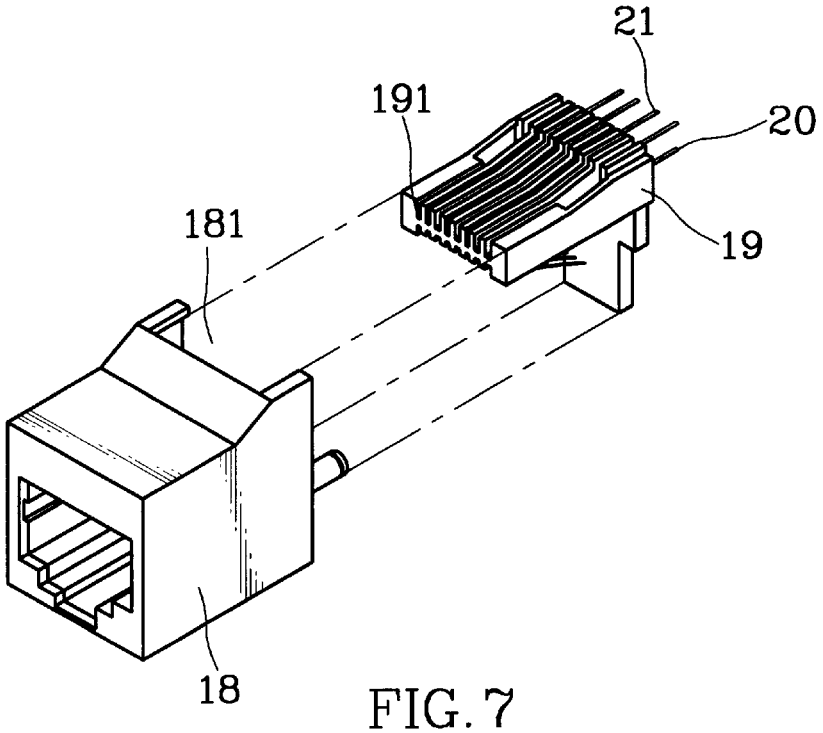
FIG. 7 (PRIOR ART)
FIG. 7 is an exploded view of another conventional connector.

FIG. 4 shows a completed assembly of this invention. The terminals 12 and 13 are held in the terminal slots 111 and 112, then the insert 11 is pushed into the socket 10 through the insert openings 103. The terminals are pressed downward by the lower pressing rib 102 until a lower section of each terminal is held in the separation ridge 104 and resting on the stopper 106. The terminals thus are securely held and precisely positioned. Afterward, a plug may be engaged with the connector through the plug opening 107. A metallic shielding cover (not shown in the picture) may further be provided to cover the socket of this invention to enhance protection against crosstalk interference.

I claim:

1. An electric connector comprising:

a socket made by plastic injection moulding including an inside cavity, a plug opening at one end for receiving a power plug, an insert opening at another end opposite to the plug opening, a plural number of separating ridges located at the insert opening, a terminal stopper located under the separating ridges, a plural number of V-shaped upper pressing ribs and a plural number of V-shaped lower pressing ribs alternately positioned below a top wall of the socket and above the cavity;

an insert made by plastics injection moulding in a L-shaped form having a covering board at one side and a terminal board normal to the covering board, the terminal board having on its top wall thereof a plural number of V-shaped upper terminal slots alternately positioned with a plural number of V-shaped lower terminal slots, and a plural number of wedge slots formed at a front end thereof, the distance between a pair of adjacent upper terminal slot and lower terminal slot being larger than the distance between a pair of adjacent wedge slots; and a plural number of terminals made by stamping a thin brass plate into terminal strips, each terminal strip having pointed bulges on two lateral edges for engaging securely to the terminal slots, wherein the insert being held in the cavity of the socket through the insert opening, the terminal being pressed by the lower pressing ribs so that a lower section of each terminal is held in the separating ridge and is rested on the stopper.

* * * * *